US006578647B2

(12) United States Patent
Page et al.

(10) Patent No.: US 6,578,647 B2
(45) Date of Patent: Jun. 17, 2003

(54) SEALING STRUCTURE FOR A ROCK DRILL BIT

(75) Inventors: Nigel M. Page, Merrillville, IN (US); Philip D. Embury, New Haw (GB)

(73) Assignee: James Walker & Company Limited, Surrey (GB)

( * ) Notice: Subject to any disclaimer, the term of this patent is extended or adjusted under 35 U.S.C. 154(b) by 0 days.

(21) Appl. No.: 09/915,014

(22) Filed: Jul. 25, 2001

(65) Prior Publication Data

US 2002/0046884 A1 Apr. 25, 2002

(30) Foreign Application Priority Data

Jul. 27, 2000 (GB) ..... 0018500

(51) Int. Cl.[7] ..... E21B 10/24

(52) U.S. Cl. ..... 175/228; 175/371; 175/372; 384/93; 384/94

(58) Field of Search ..... 175/228, 371, 175/372; 384/93, 94; 277/336, 634, 635

(56) References Cited

U.S. PATENT DOCUMENTS 2,743,737 A * 5/1956 Textor ..... 137/493
3,719,241 A * 3/1973 Bell ..... 175/228
3,741,321 A * 6/1973 Slover et al. ..... 175/107
3,847,234 A * 11/1974 Schumacher et al. ..... 175/228
3,935,911 A * 2/1976 McQueen ..... 175/17
3,990,525 A * 11/1976 Penny ..... 175/337
4,161,223 A * 7/1979 Oelke ..... 137/540
4,727,942 A * 3/1988 Galle et al. ..... 175/228
5,072,795 A * 12/1991 Delgado et al. ..... 175/228
6,138,778 A * 10/2000 Price et al. ..... 137/493.9
6,474,424 B1 * 11/2002 Saxman ..... 175/371

* cited by examiner

*Primary Examiner*—William Neuder
*Assistant Examiner*—Shane Bomar
(74) *Attorney, Agent, or Firm*—Hodgson Russ LLP

(57) ABSTRACT

A sealing structure for a rock drill bit includes an elastomeric diaphragm for installation in the drill bit so as to separate grease from drilling mud. The diaphragm has an aperture extending through it, and a plug is disposed in the aperture so as to form a mechanical seal with a wall of the aperture. The plug has a channel therethrough which is normally held sealed by a face of the aperture in the diaphragm. If the pressure of the grease exceeds pressure in mud on the other side of the diaphragm by more than a critical value, the diaphragm aperture deforms and allows grease to move through the plug channel and escape. The critical value can be varied by using, with the same diaphragm, plugs having different numbers, sizes and axial positions of plug channels.

17 Claims, 3 Drawing Sheets

SEALING STRUCTURE FOR A ROCK DRILL BIT

BACKGROUND OF THE INVENTION

The invention relates to a sealing structure for a rock drill bit and, more particularly, to a sealing structure that includes a diaphragm as a fluid pressure compensator and a relief valve between lubricant and mud regions.

Rock drill bits have multiple rotating heads which are caused to rotate by rotation of the drill pipe stem. The rotating heads are mounted on bearings which receive lubrication from a reservoir, with rotary seals preventing escape of the lubrication. Due to fluctuations in the pressure differential between the lubricant and the mud surrounding the rotating heads, a pressure relief mechanism has to be provided to lower lubricant pressure when the differential exceeds an amount that may damage the rotary seals; such damage results in both downtime and high repair cost.

The pressure relief mechanism for such lubrication systems normally includes an elastomeric compensating diaphragm as well as an associated means that allows lubricant to flow through or around the diaphragm if the pressure differential thereacross exceeds a predetermined value. A variety of such diaphragms are shown, for instance, in the following U.S. Pat. No. 3,847,234 (Schumacher); U.S. Pat. No. 4,161,223 (Oelke); U.S. Pat. No. 4,727,942 (Galle); and, U.S. Pat. No. 5,072,795 (Delgado). In Schumacher, the diaphragm is generally planar with corrugations, and has a central orifice through which lubricant can pass if the pressure differential exceeds a predetermined value. In Oelke, lubricant escapes around the edges of an accordion-shaped diaphragm if the pressure differential exceeds the force exerted by a belleville spring holding a cover cap against the base of the diaphragm. In Galle, the diaphragm is centrally sealed in a chamber and movable between opposite ends of the chamber, depending on the relative pressure differential across it. A central portion of the diaphragm has a perforation that is normally closed but is forced open if the lubricant pressure exceeds the mud pressure by more than a maximum differential; the perforation does not open to allow mud through, no matter how high the pressure differential. In Delgado, a self-sealing puncture is included in the diaphragm and opens when the pressure differential exceeds a critical value to allow either the mud or the lubricant having the higher pressure to pass through the puncture; once the pressure differential reduces below the critical value, the puncture self-seals to prevent further fluid passing through it.

SUMMARY OF THE INVENTION

It would be advantageous to be able to adjust a maximum pressure differential across a diaphragm without requiring a replacement of the diaphragm.

It would also be advantageous to be able to adjust such maximum pressure differential in a simple and rapid manner.

In one aspect, the invention is a sealing structure for a rock drill bit. The sealing structure includes an elastomeric diaphragm for installation in the drill bit so as to separate lubricant from drilling mud. The diaphragm has an aperture therethrough, and a plug is disposed in the aperture to form a mechanical seal with a wall thereof. The plug has a bore therethrough which is closed by the expanded diaphragm. Excess pressure in the lubricant is communicated via the bore to the aperture wall to deform the wall locally and vent the excess pressure.

The plug preferably forms an interference fit with the aperture of the diaphragm.

The bore of the plug preferably has an axial segment and a radial segment. The axial segment extends from an open plug end on the lubricant side of the diaphragm to a closed plug end on the mud side of the diaphragm. The radial segment comprises one or more channels each of which connects the axial segment of the bore to a corresponding side opening on the plug.

In a preferred form, the diaphragm when unstressed is generally cup-shaped, an inner side of the diaphragm being the lubricant side, and wherein the diaphragm is adapted to be secured by its larger open end to the rock drill bit. In a more preferred form, the diaphragm may have a generally frustoconical configuration, and includes a tapering sidewall integrally connected at its smaller end to a generally circular base.

The plug may preferably extend through the diaphragm at a central position on the diaphragm base.

The plug may engage with a collar that is mounted on an inside surface of the diaphragm base. Preferably, the plug engages with the collar by means of complementary threads. Preferably, the open plug end is configured for accepting a rotatable end of a drive tool for rotating the plug relative to the collar.

A series of protrusions may surround an entrance to the aperture on an outside surface of the diaphragm base. The larger open end of the diaphragm has a toroidal shape which is adapted to be held between mating parts of the rock drill bit for holding the diaphragm in position on the bit.

In any of the foregoing forms of the sealing structure, the diaphragm may be elastomeric, the plug may be metallic, and the collar may be metallic. The lubricant used in the sealing structure may be grease.

The aperture wall may deform to allow lubricant to pass through the sealing structure at an excess pressure in the range between 3.5 and 35 kg/cm2 (50 and 500 psi), In another aspect, the invention is one of the foregoing forms of the sealing structure, in combination with the rock drill bit.

Preferred features of the invention will now be described, by way of example only, with reference to the accompanying drawings, in which:

DETAILED DESCRIPTION OF THE INVENTION

Figure 1:
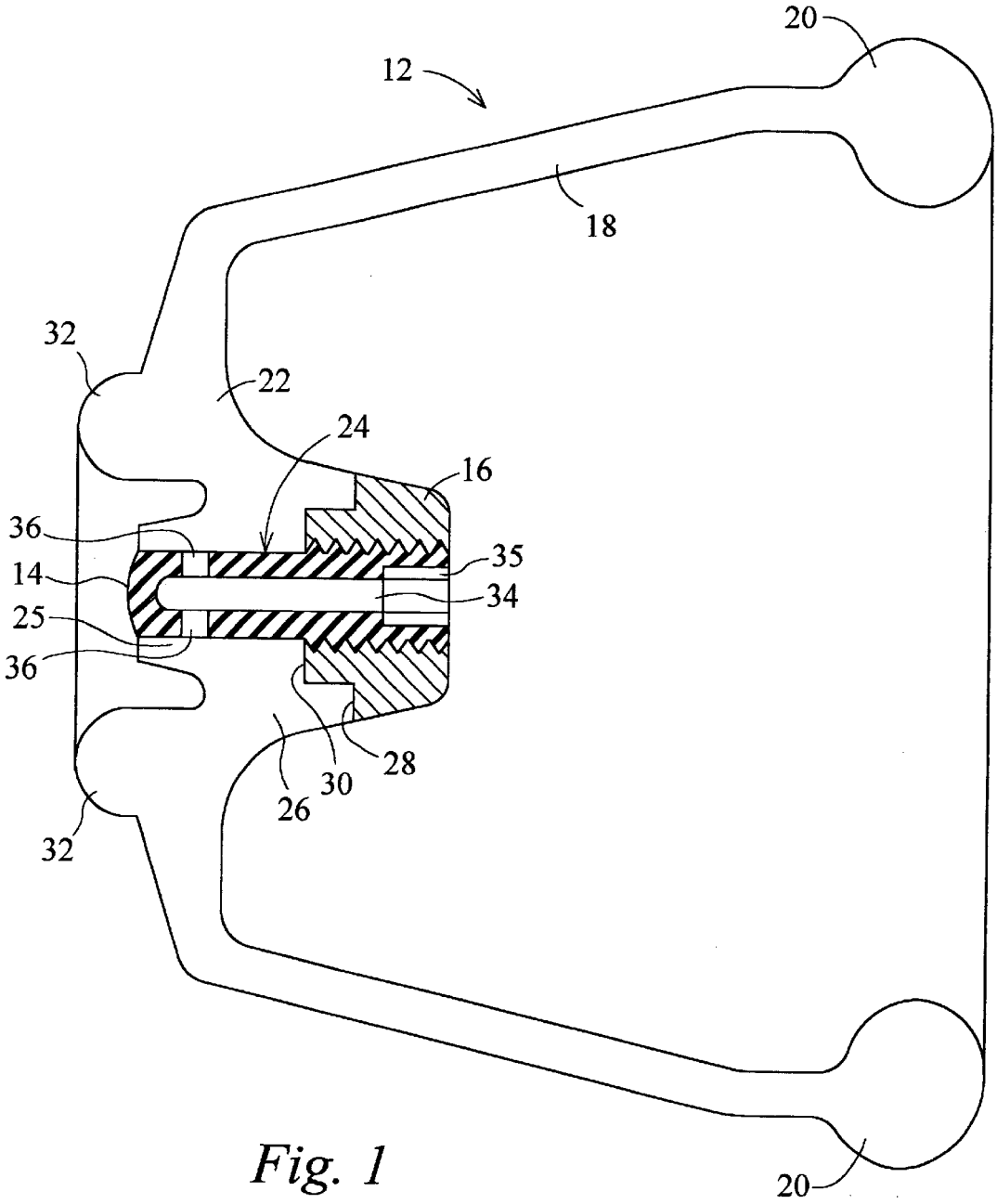
FIG. 1 is a cross-sectional view of a sealing structure of the preferred embodiment of the invention.

Referring to FIG. 1, the sealing structure includes an elastomeric diaphragm generally designated 12, a metal plug 14, and a metal collar 16.

The diaphragm 12 is frustoconical-shaped, with an open large end and a closed small end. At the large end the sidewall 18 thickens to become an integral annular sealing ring 20. At the small end, the sidewall 18 is integrally connected to a circular base 22 having a central aperture 24 extending therethrough, defined at its outer end by relatively thin walls 25.

On the inner side of the circular base 22 of diaphragm 12 is a central raised inner hub 26 having an outer lip 28 and recessed center 30; on the outer side of the circular diaphragm base 22 is an annular protrusion 32. The metal collar 16 is disc-shaped, and has a threaded central aperture which may be tapered. One side of metal collar 16 is configured to have a complementary fit with the inner hub 26, and the two are chemically bonded together.

An outside of a first end of metal plug 14 has a thread complementary to the thread on metal collar 16, and an outside of a second end of metal plug 14 forms an interference fit with the central aperture 24 of circular diaphragm base 22.

A bore 34 extends centrally in the plug 14 from an open first end of plug 14 to a closed second end. An initial segment 35 of bore 34 at the open first end of plug 14 has an hexagonal profile allowing positive engagement of an allen wrench for rotating plug 14 into collar 16; sealant thread may be used. Alternatively, a cross-head slot on the first end of plug 14 might be used, with a screwdriver being then used to rotate plug 14. As can be seen in FIG. 1, two radial bores 36 extend from bore 34 to the outside of plug 14, and are closed by portions of the relatively thin walls 25.

Figure 2:
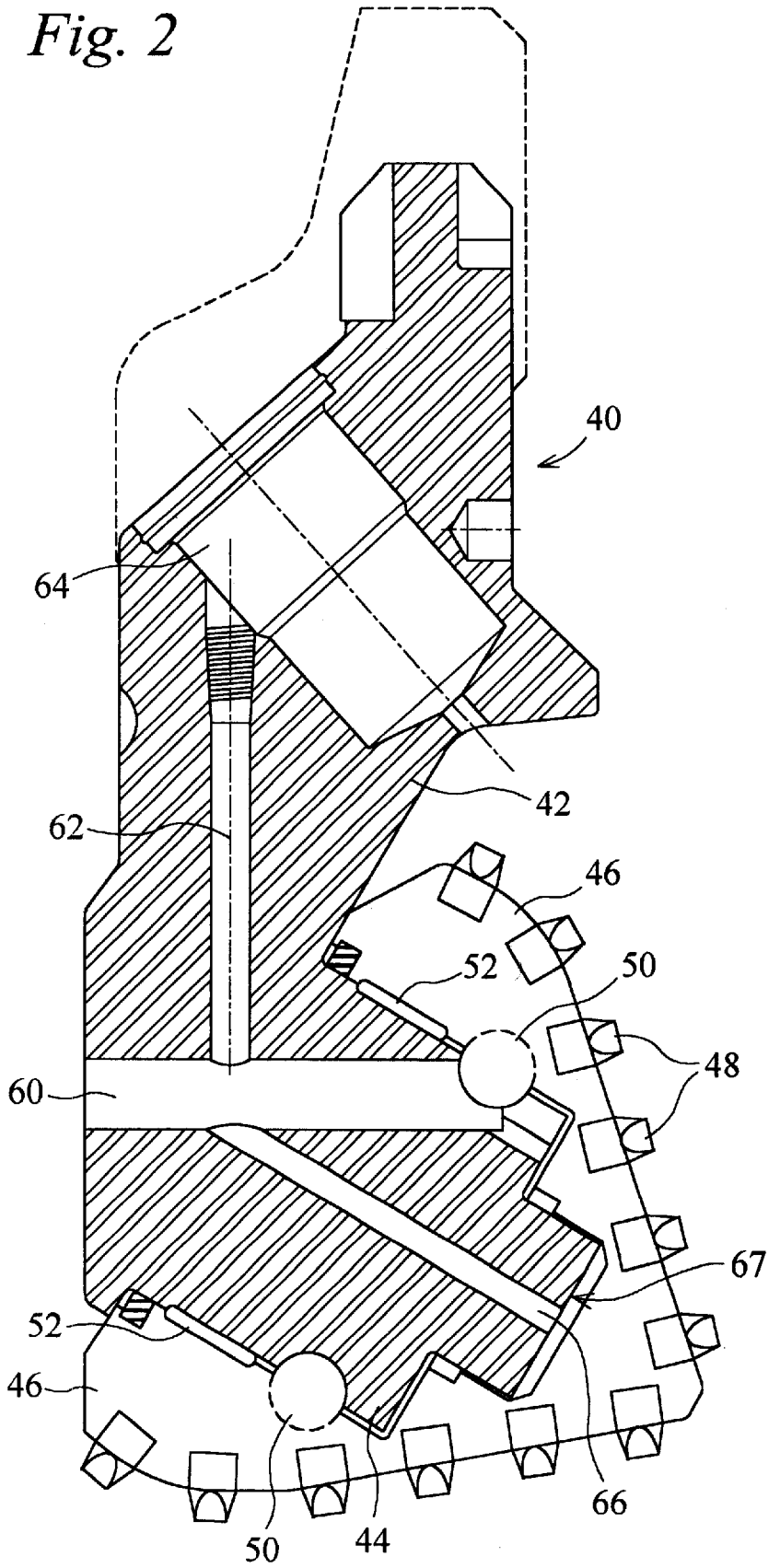
FIG. 2 is a cross-sectional view of a rock drill bit ready to receive the sealing structure of FIG. 1; and, FIG. 3 is a cross-sectional view of the sealing structure of FIG. 1 and of the immediate surrounding structure of the rock drill bit of FIG. 2 after the sealing structure has been installed therein.
Figure 3:
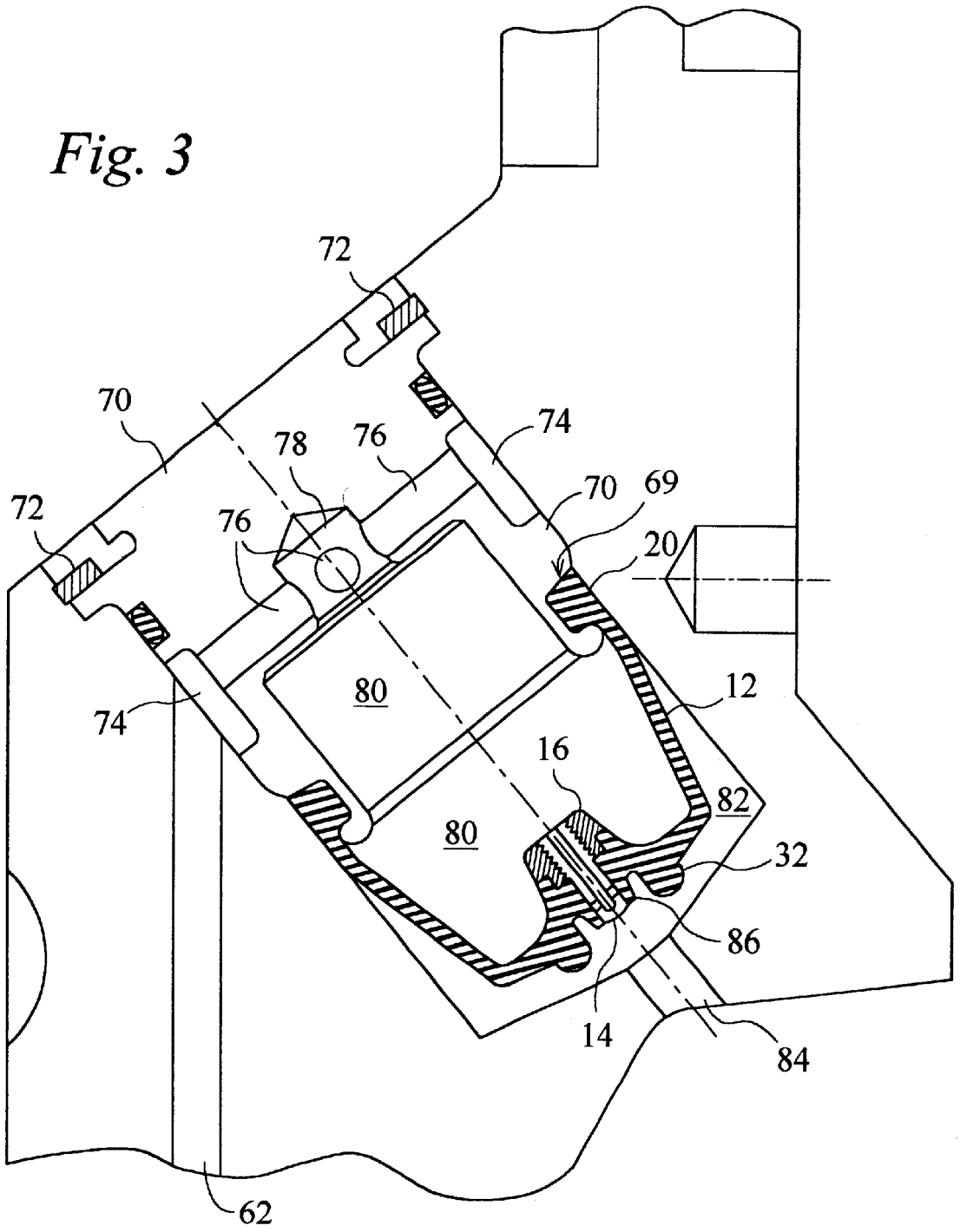

FIG. 2 illustrates in cross-section a rock drill bit 40 into which the sealing structure is to be installed, and FIG. 3 is a cross-sectional view of the sealing structure and a surrounding portion of the rock drill bit 40 after the sealing structure has been installed therein.

Rock drill bit 40 has a main body from which extend downwardly and outwardly, at equiangular positions around the axis of the drill stem, a number (typically 2, 3 or 4) of legs 42. At the outer end of each leg 42 is an integral bearing journal 44 on which is rotatably mounted a conical roller cutter 46 having a series of cutters 48 affixed thereto. A series of ball bearings 50 extend around the periphery of bearing journal 44. Additional bearings 52 sit between roller cutter 46 and bearing journal 44 in this embodiment; such bearings may not be present in other embodiments. Grease is fed through a radial channel 60 on rock drill bit 40 to lubricate bearings 50, 52. From radial channel 60, the grease extends through a first smaller channel 62 to a chamber 64, and also extends into a second smaller channel 66 to lubricate an end face 67 of bearing journal 44.

FIG. 3 illustrates the situation after the sealing ring 20 of the sealing structure of the invention has been fitted into an annular groove 69 of a cover cap 70 and both have been pressed into the chamber 64. A split ring 72 holds cover cap 70 in chamber 64. The cover cap 70 has an annular outer channel 74 in flow communication with first smaller channel 62, and has a number of radial channels 76 (here, four) that are connected to the annular outer channel 74. The radial channels 76 feed into a hub cavity 78 which opens into a grease chamber 80 into which faces the metal collar 16 and the inside surface of diaphragm 12. On the outside surface of diaphragm 12 is mud which enters into a mud chamber 82 from the outside of rock drill bit 40 through the entry hole 84. Grease chamber 80 and mud chamber 82 are defined by being on opposite sides of the sealing structure of the invention.

In operation of the rock drill bit 40, the pressure differential between grease chamber 80 and mud chamber 82 is normally such that the sealing structure of the invention is maintained in the central position shown in FIG. 3. As the pressure an grease chamber 80 increases above that in mud chamber 82, sufficient force is applied via the grease to the part of the wall 25 closing the radial bores 36 for the wall to be deformed away from the surface of the outer end of the plug 14. Thus grease passes through the bore 34 and the radial bores 36 and flows out between the face of aperture 24 and the sidewall of plug 14, and may flow on out through entry hole 84. The grease first starts to pass through plug 14 at a maximum pressure differential that is set (for a given diaphragm material, thickness of wall 25 and degree of interference between the aperture 24 and the plug 14) according to the number, diameter and axial position of the radial bores 36; that pressure differential is normally between 3.5 and 35 kg/cm2 (50 and 500 psi). Once the pressure in the grease chamber 80 reduces, the reverse process occurs and grease ceases to pass through the plug 14. Excessive deformation of the diaphragm 12 under internal grease pressure is prevented by diaphragm 12 expanding and the annular protrusion 32 coming into contact with the wall of mud chamber 82 close to entry hole 84.

If the pressure in mud chamber 82 should increase above that in grease chamber 80, the collar 16 is eventually pushed into hub cavity 78 of cover cap 70 but can move no further. Increasing the pressure of mud chamber 82 further does not result in mud passing through the plug 14; on the contrary, the wall 25 of diaphragm 12 that surrounds the sidewall of plug 14 is pressed more firmly against the sidewall as the pressure increases. Thus, mud cannot flow from mud chamber 82 into the four radial channels 76 of cover cap 70 and into the rest of the lubrication system.

By producing plugs 14 that vary in the number, diameter and axial position of the radial bores 36, it is possible to vary a maximum pressure differential at which grease starts to escape through the sealing structure of the invention. Only one size of diaphragm 12 needs to be produced, and only the plug 14 needs to be replaced to produce a sealing structure that allows grease to flow through it at a new pressure differential.

While the present invention has been described in its preferred embodiments, it is to be understood that the words which have been used are words of description rather than limitation, and that changes may be made to the invention without departing from its scope as defined by the appended claims.

Each feature disclosed in this specification (which term includes the claims) and/or shown in the drawings may be incorporated in the invention independently of other disclosed and/or illustrated features.

What is claimed is:

1. A sealing structure for a rock drill bit, comprising an elastomeric diaphragm for installation in the drill bit so as to separate lubricant from drilling mud, the diaphragm having an aperture therethrough, a plug being disposed in the aperture so as to form a mechanical seal with a wall thereof, the plug having a bore therethrough which is closed by the diaphragm, excess pressure in the lubricant being communicated via the bore to the aperture wall to deform the wall locally and vent the excess pressure.

2. The sealing structure as in claim 1, wherein the plug forms an interference fit with the aperture of the diaphragm.

3. The sealing structure as in claim 2, wherein the bore of the plug has an axial segment and a radial segment, the axial segment extending from an open plug end on the lubricant side of the diaphragm, the radial segment comprising one or more channels each connecting the axial segment of the bore to a corresponding side opening on the plug.

4. The sealing structure as in claim 3, wherein the diaphragm when unstressed is generally cup-shaped, an inner side of the diaphragm being the lubricant side, and wherein the diaphragm is adapted to be secured by its larger open end to the rock drill bit.

5. The sealing structure as in claim 1, wherein the bore of the plug has an axial segment and a radial segment, the axial segment extending from an open plug end on the lubricant side of the diaphragm, the radial segment comprising one or more channels each connecting the axial segment of the bore to a corresponding side opening on the plug.

6. The sealing structure as in claim 5, wherein the diaphragm when unstressed is generally cup-shaped, an inner side of the diaphragm being the lubricant side, and wherein the diaphragm is adapted to be secured by its larger open end to the rock drill bit.

7. The sealing structure as in claim 6, wherein the diaphragm has a generally frustoconical configuration, and includes a tapering sidewall integrally connected at its smaller end to a generally circular base.

8. The sealing structure as in claim 6, wherein the larger open end of the diaphragm has a toroidal shape which is adapted to be held between mating parts of the rock drill bit for holding the diaphragm in position on the bit.

9. The sealing structure as in claim 7, wherein the plug extends through the diaphragm at a central position on the diaphragm base.

10. The sealing structure as in claim 7, wherein a series of protrusions surround an entrance to the aperture on an outside surface of the diaphragm base.

11. The sealing structure as in claim 9, wherein the plug engages with a collar that is mounted on an inside surface of the diaphragm base.

12. The sealing structure as in claim 11, wherein the plug engages with the collar by means of complementary threads.

13. The sealing structure as claim 11, wherein the collar is metallic.

14. The sealing structure as in claim 12, wherein the open plug end is configured to accept a rotatable end of a drive tool for rotating the plug relative to the collar.

15. The sealing structure as in claim 1, wherein the plug is metallic.

16. The sealing structure as in claim 1, wherein the lubricant is grease.

17. The sealing structure as in claim 1, wherein the aperture wall deforms at a pressure between 3.5 and 35 $kg/cm^2$ (50 and 500 psi).

* * * * *